US006525485B2

(12) United States Patent
Kasano et al.

(10) Patent No.: US 6,525,485 B2
(45) Date of Patent: Feb. 25, 2003

(54) VACUUM FLUORESCENCE DISPLAY

(75) Inventors: Kazuhiko Kasano, San Diego, CA (US); Duane A. Haven, Escondido, CA (US); W. Edward Naugler, Jr., Escondido, CA (US)

(73) Assignee: Display Research Laboratories, Inc., Burlingame, CA (US)

( * ) Notice: Subject to any disclaimer, the term of this patent is extended or adjusted under 35 U.S.C. 154(b) by 0 days.

(21) Appl. No.: 09/952,776

(22) Filed: Sep. 14, 2001

(65) Prior Publication Data

US 2002/0067135 A1 Jun. 6, 2002

Related U.S. Application Data

(60) Provisional application No. 60/233,806, filed on Sep. 19, 2000.

(51) Int. Cl.[7] ..... H01J 31/15

(52) U.S. Cl. ..... 315/169.4; 313/495; 313/496

(58) Field of Search ..... 313/495, 496, 313/497; 315/169.4

(56) References Cited

U.S. PATENT DOCUMENTS

| | | | | |
|---|---|---|---|---|
| 4,164,683 A | | 8/1979 | Nakamura et al. | |
| 4,410,830 A | | 10/1983 | DuBois, Jr. | |
| 5,541,478 A | | 7/1996 | Troxell et al. | |
| 5,736,814 A | | 4/1998 | Kinoshita et al. | |
| 5,739,634 A | * | 4/1998 | Kinoshita et al. | 313/495 |

* cited by examiner

*Primary Examiner*—David Vu
(74) *Attorney, Agent, or Firm*—Dorsey & Whitney LLP

(57) ABSTRACT

An improved vacuum fluorescence display (VFD) that is less expensive to produce and more rugged than currently available VFDs. The display includes metal side walls and fluorescent material carried on one or more silicon wafers. A ceramic, layerable insulating material is employed as the substrate on which the wafer or wafers are mounted. In another embodiment of the current invention, a chemical getter is incorporated into a recess formed in the ceramic substrate. The getter is positioned underneath the back side of the phosphor screen so as to significantly reduce contamination of the screen by material sputtered off of the surface of the getter.

9 Claims, 1 Drawing Sheet

VACUUM FLUORESCENCE DISPLAY

RELATED APPLICATIONS

This application claims priority to Provisional Application Serial No. 60/233,806 filed Sep. 19, 2000.

FIELD OF THE INVENTION

This invention relates generally to a vacuum fluorescence display (VFD) for displaying visual information, and more particularly to an improved VFD assembly and method of manufacture.

BACKGROUND OF THE INVENTION

VFD displays using a glass vacuum envelope are known. Since a VFD is essentially a triode tube having a hot filament, an electron smoothing grid and phosphorous anodes, the same techniques used for making electronic vacuum tubes are commonly applied to the manufacture of VFDs.

Standard VFDs are thus generally constructed entirely of glass as are electron vacuum tubes. However, use of glass in VFD construction introduces several difficulties. Glass is heavy relative to other possible materials. Additionally, to provide sufficient VFD durability, the thickness of the walls of a glass VFD must be substantial. A light shield is required to prevent light from penetrating the VFD in undesired directions such as the sides and back of the VFD. Glass can accumulate static charges which can interfere with operation of low-voltage VFDs. Finally, glass VFDs are sealed with a glass frit that tends to out-gas substantially, leading to degradation of the internal vacuum inside the VFD.

The use of glass in standard VFDs also includes the base on which the phosphor screen is mounted. Glass is a non-ideal material for this application because of relatively high costs—glass formations require carbon jigs that have a short life at the glass melting temperature even in an inert atmosphere. Sintering temperatures in a glass VFD are approximately 500° C. At this relatively low temperature, metallic patterns printed on the glass surface are attached mainly by frit fixing, a process that does not give ideal adhesion and which leads to lower conductivity and potential oxidation of the electronic contacts. Additionally, only one layer of circuitry can be printed on a glass surface.

Electronic contacts connecting internal circuitry to outside the VFD are also a serious weakness of standard VFD design. The weak point of the vacuum package is where the metal leads pass through the glass frit from the inside of the vacuum package to the outside. The getter in the package is fired using RF energy, which heats up the getter to the point where it fires (the getter is like molecular fly paper and absorbs gasses that outgas from the surfaces inside the vacuum envelope and that continually reduce the vacuum after the package is sealed). In a small VFD package, the lead frame is positioned too close to the getter and also heats up during getter firing. This can cause a thermal fracture to occur in the frit around the lead frame, thus causing the package to lose vacuum and fail.

In standard VFDs constructed of glass, the getter is generally placed beside the phosphor screen. This placement requires additional VFD footprint that is not usable for displaying visual information and may lead to problems of screen contamination by the getter material during getter firing. Standard getters are of the evaporation type—during firing of the VFD envelope, the getter sputters barium metal (typically) throughout the interior of the vacuum package.

This can lead to further contamination. Technology that allows the getter to be placed after firing would solve this problem.

SUMMARY

Accordingly, it is an object of the present invention to provide an improved vacuum fluorescence display (VFD) constructed substantially out of an alternate material than glass. The display includes metal sidewalls and fluorescent material carried on one or more silicon wafers. A ceramic, layerable insulating material is employed as the substrate on which the wafer or wafers are mounted. Standard VFDs use glass for both the sidewalls and the substrate base for the silicon wafer or wafers. In another embodiment of the current invention, a chemical getter is incorporated into a recess formed in the ceramic substrate. The getter is positioned underneath the backside of the phosphor screen so as to significantly reduce contamination of the screen by material sputtered off of the surface of the getter.

More specifically, the present invention provides an improved vacuum fluorescence display formed of a ceramic substrate, a metal collar sealed to one surface of the ceramic substrate, and a viewing window disposed approximately parallel to the ceramic substrate and sealed to the metal collar to form a sealed, evacuated interior volume. Inside this sealed interior volume, there is a phosphor screen mounted on the ceramic substrate. The phosphor screen is formed of phosphor pixels disposed in a grid pattern on one or more semiconductor chips which contain integrated circuits that form a matrix of anodes. Via the internal circuitry of the semiconductor chips, these anodes can be individually energized to activate the phosphor screen in a desired pattern. The semiconductor chips are powered and controlled by a plurality of electronic connections. The VFD also includes a getter formed of a chemically reactive material that is mounted inside of the sealed, evacuated interior volume and beneath the phosphor screen. A number of filament cathodes inside the sealed interior volume between the viewing window and the phosphor screen provide a source of free electrons that are accelerated toward the phosphor screen by a mesh biasing grid positioned between the filament cathodes and the phosphor screen.

DETAILED DESCRIPTION OF THE INVENTION

Figure 1:
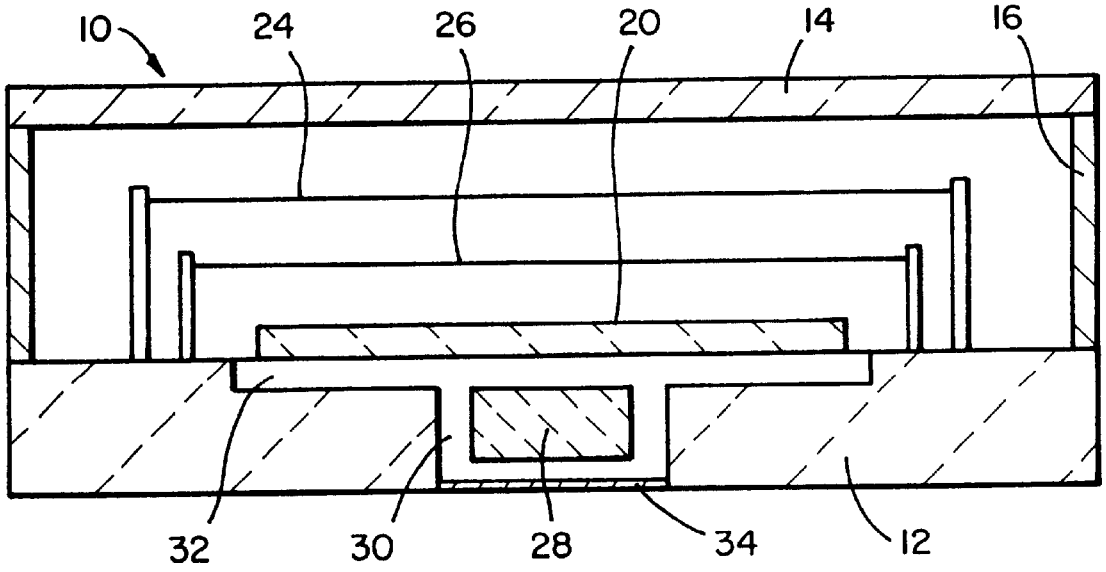
FIG. 1 is a schematic diagram showing a vertical cross-section of a VFD according to one embodiment of the current invention.
Figure 2:
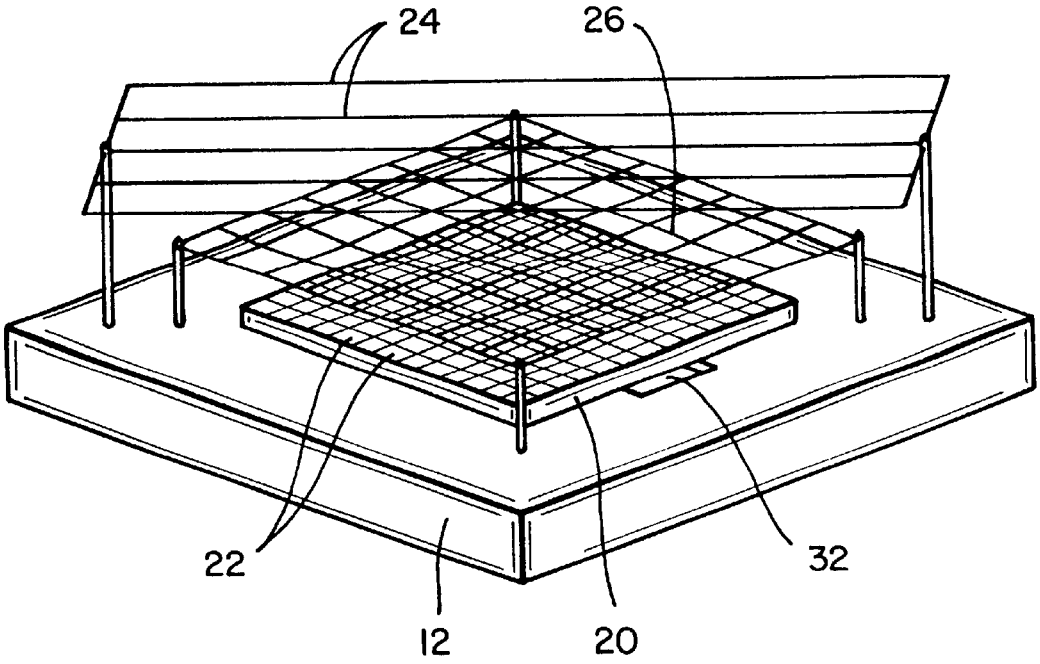
FIG. 2 is a schematic perspective view of a VFD according to one embodiment of the current invention.

FIG. 1 is a vertical cross-sectional view of a VFD 10 in accordance with one embodiment of the present invention. FIG. 2 is a tear-away perspective view of a VFD in accordance with one embodiment of the present invention. The VFD comprises a ceramic substrate or base 12, a transparent viewing window 14, and a metal collar 16 to provide spacing between the viewing window 14 and the ceramic substrate 12. The viewing window is preferably made of glass. More preferably, the glass is tinted to have a transmission spectrum matched to the light emissions from the phosphor screen to thereby obtain a desired viewable color output.

The ceramic substrate supports one or more semiconductor chips 20. On the surface of these one or more semiconductor chips are a plurality of pixels 22 of fluorescent material disposed on individually energized anodes (not shown) which are controlled to attract electrons. Electronic connections (not shown) which control voltages to the anodes extend to the exterior of the device. As is known in vacuum fluorescence displays, means are provided for the formation of an electron cloud. One or more electron emitting filament cathodes 24 are positioned between the one or more semiconductor chips and the viewing window 14. A mesh grid 26 is interposed between the one or more filament cathodes 24 and the one or more semiconductor chips 20. A metal collar or housing 16 overlies the ceramic substrate 12 and supports the viewing window 14. The metal collar and any other metal that is sealed to the ceramic substrate or other glass surfaces of the VFD are preferably of a material that both wets the solder used to create the seal and has a CTE that is compatible with the ceramic and/or glass to which it is sealed.

When the unit is assembled, selected anodes on the one or more semiconductor chips have a positive voltage applied to attract electrons and cause the phosphors to emit light thereby providing a display which is viewed through the viewing window 14 and through the mesh grid 26. A getter 28 is positioned behind the phosphor screen surface. More preferably, the getter is placed in a hole 30 in the ceramic substrate. One or more exhaust trenches 32 are provided in the substrate to allow flow of gas from the interior volume to the getter 28 positioned in the hole 30. The hole is sealed with an exhaust hole lid 34. The hole lid is formed of a 426-alloy.

In a further embodiment of the present invention, a plurality of electronic leads are provided from the exterior of the VFD to the one or more semiconductor chips. These electronic leads may be passed beneath the metal collar 16 via an insulating frit trench. The frit prevents short-circuiting of the electronic leads by the metal collar. More preferably, the electronic leads are routed from the one or more semiconductor chips between one or more layers of the ceramic substrate. The ceramic layers provide electrically insulated paths and also allow the creation of multiple layers of circuitry if so desired.

The current invention solves many of the problems associated with earlier VFDs. Ceramic layers can be stacked allowing inner wiring, and via holes permitting cross-over wiring for sophisticated circuitry. Metallic patterns printed on the ceramic after sintering have a much higher adhesion force to the substrate than metallic patterns on glass, because ceramic sintering temperature is 950° C. instead of 500° C. as for glass. Thus, metal parts can be brazed onto the substrate instead of using frit fixing as in current VFD construction. Brazing gives better conductivity and substantially reduced metal oxidation.

Because ceramic is opaque, no additional light shielding is required on the substrate base. The same is true for the metal collar.

Since the ceramic can be shaped prior to firing, an exhaust hole with room for the getter can be designed into the ceramic base. Therefore, the getter is moved away from the display chip (actually it is under the display chip). This means that extra footprint room is not needed for the getter placement. Also, the chance of getting barium metal (the getter material) on the phosphors is eliminated. Thus, no getter shield is required. The placement of the getter in the exhausting holes yields a further benefit: a non-evaporation type getter can be used. Since the getter is in the exhaust hole, it can be inserted in the same operation of exhausting and capping off. In order to cap the device (seal it) the cap is heated to about 450° C. This presents the opportunity to include the non-evaporation getter in the cap heating cycle during the pump evacuation of the part. Non-evaporation getters are made from a highly absorptive material. Since the getter material has been at atmospheric pressure, it has to be held and heated in a vacuum to regenerate its absorptive properties. This is done at the capping operation, this type of getter eliminates the RF heating requirement and also the chance that debris from the getter firing will fly around inside the package with consequential loss in yield.

Detailed Example of the Manufacturing Process

The following is an outline of the steps of one potential embodiment of the manufacturing process for an improved VFD provided by the current invention.

The substrate consists of a multi-stacked layer of Forsterite. The middle layer of this substrate includes a tripod rib for supporting a getter. The outside dimensions of the substrate bottom layer are preferably approximately 24×16×0.3 mm. The top layer of the substrate has several channels cut in it, including one that serves as a path for exhausting gas and a second channel that is utilized to insert a getter spring. The top layer is preferably approximately 0.8 mm thick. A third, shallower channel, is also formed in the top layer to prevent the possibility of a short circuit when the metal collar is added to the substrate during the sealing process. The third trench is preferably approximately 0.1 mm deep. The stacked layers are fired and then printed with a circuit pattern using resinate gold.

Next, an outer rim is formed around the substrate with frit glass that is baked to obtain a vitrified glass outer rim. The getter is placed, flash side down, into the center hole of the substrate. The getter spring is then inserted through the second channel to press and hold the getter in place. Eutectic solder is preferably used to fix the spring, and may be melted by heat bar or by laser beam.

A phosphor-coated semiconductor chip or chips are placed on the substrate using bonding paste. After curing of the bonding paste, wires are bonded to the leads from the pads.

A grid mesh is etched. It is preferably sized at approximately 10×7×0.02 mm. A grid frame is press-formed and the mesh is welded to the frame. This welding is preferably done by laser beam.

Two filament supports are press-formed and attached to a base. A feather spring is etched, bent, and placed onto one of the filament supports. The spring is welded to the filament support preferably by a laser beam. Two filament wires are stretched between the supports and welded, preferably by laser beam, to one support and to the feather spring on the other support. The tensile force on the filament wires is preferably 7 grams.

A viewing window with a filter and ITO coating on one side is precut. A metal collar is formed by a press and then oxidized in an air-baking oven. The viewing window and metal collar are sealed together by glass frit. The grid and grid support is placed on the substrate and brazed, preferably by eutectic solder with a laser beam. Next, the filament assembly is placed in the correct position on the substrate and brazed to the substrate, preferably with a laser beam.

Finally, the substrate assembly and the viewing window-metal collar assemblies are matched. The entire VFD assembly is clipped and placed on a sealing belt furnace to be sealed at 480° C. in a nitrogen and carbon dioxide atmosphere. The assembly is placed on a multi-head exhaust station. The vacuum envelope is sealed by closing the exhaust hole with an exhaust hole lid. An RF bombarder flashes the getter.

What is claimed is:

1. An improved vacuum fluorescence display comprising:

a ceramic substrate;

a metal collar, said metal collar sealed to one surface of said ceramic substrate;

a viewing window, said viewing window spaced from and disposed approximately parallel to said ceramic substrate and sealed to said metal collar;

a phosphor screen mounted on said ceramic substrate, said phosphor screen comprising phosphor pixels disposed in a grid pattern on one or more semiconductor chips, said semiconductor chips containing integrated circuits that form a matrix of anodes, said anodes be individually energizable in a desired pattern;

a getter, said getter formed of a chemically reactive material, said getter mounted inside of said sealed, evacuated interior volume beneath said phosphor screen;

one or more filament cathodes disposed between said phosphor screen and said viewing window; and a biasing grid disposed between said phosphor screen and said one or more filament cathodes.

2. The vacuum fluorescence display of claim 1 wherein an exhaust hole having room for said getter is formed in said ceramic substrate, said exhaust hole being sealed with an exhaust hole lid.

3. The vacuum fluorescence display of claim 2 wherein, said getter is of a non-evaporative type and said exhaust hole lid is formed of a 426-alloy.

4. The vacuum fluorescence display of claim 1 wherein said ceramic substrate is formed of Forsterite.

5. The vacuum fluorescence display of claim 1 wherein said viewing window is formed of glass.

6. The vacuum fluorescence display of claim 5 wherein said glass viewing window is tinted to have a transmission spectrum matched to said phosphor pixels to obtain a desired viewable color output.

7. The vacuum fluorescence display of claim 1 further comprising a plurality of electronic connections providing power from an external source to said one or more semiconductor chips.

8. The vacuum fluorescence display of claim 7 wherein said plurality of electronic connections to said one or more semiconductor chips are provided via a frit trench beneath said metal collar, said frit trench insulating said plurality of electronic connections from contact with said metal collar.

9. The vacuum fluorescence display of claim 7 wherein said ceramic substrate is formed of two or more layers of ceramic material, said two or more layers of ceramic material providing electrically insulted connection paths for said plurality of electronic connections to said one or more semiconductor chips are routed.

* * * * *